United States Patent [19]

Blain et al.

[11] Patent Number: 5,068,046

[45] Date of Patent: Nov. 26, 1991

[54] LUBRICANT COMPOSITION COMPRISING AN OCTADECYLENE OXIDE POLYAMINE REACTION PRODUCT

[75] Inventors: David A. Blain, Mt. Laurel; Angeline B. Cardis, Florence, both of N.J.

[73] Assignee: Mobil Oil Corporation, Fairfax, Va.

[21] Appl. No.: 657,287

[22] Filed: Feb. 19, 1991

Related U.S. Application Data

[63] Continuation of Ser. No. 460,691, Jan. 4, 1990, abandoned, which is a continuation-in-part of Ser. No. 276,010, Nov. 25, 1988, abandoned.

[51] Int. Cl.[5] ..... C10M 133/08

[52] U.S. Cl. ..... 252/51.5 A

[58] Field of Search ..... 252/51.5 R

[56] References Cited

U.S. PATENT DOCUMENTS

| | | | |
|---|---|---|---|
| 3,235,501 | 2/1966 | Waldmann | 252/51.5 R |
| 3,794,586 | 2/1974 | Kimura | 252/51.5 R |
| 3,907,745 | 9/1975 | Bsharah et al. | 260/45.9 AA |

FOREIGN PATENT DOCUMENTS

| | | | |
|---|---|---|---|
| 55-118998 | 3/1979 | Japan . | |
| 56-100898 | 1/1980 | Japan . | |
| 118998 | 9/1980 | Japan | 252/51.5 R |
| 60-240795 | 5/1984 | Japan . | |
| 262893 | 12/1985 | Japan | 252/51.5 R |
| 2142651 | 1/1985 | United Kingdom . | |

OTHER PUBLICATIONS

D. Chasan, *Stabilization of Petroleum Products*, CRC Press, Inc., 1990, p. 299.

T. W. Graham Solomons, *Fundamentals of Organic Chemistry*, John Wiley & Sons (N.Y. 1986), p. 358.

*Primary Examiner*—Prince Willis, Jr.
*Assistant Examiner*—Jerry D. Johnson
*Attorney, Agent, or Firm*—Alexander J. McKillop; Charles J. Speciale; Jessica M. Sinnott

[57] ABSTRACT

A lubricant or fuel composition contains a major portion of a lubricant or fuel and a minor portion of an additive composition which is the reaction product of long chain epoxides and polyamines such as polyethyleneamines.

16 Claims, No Drawings

LUBRICANT COMPOSITION COMPRISING AN OCTADECYLENE OXIDE POLYAMINE REACTION PRODUCT

This is a continuation of Ser. No. 460,691, filed on Jan. 4, 1990, now abandoned, which is a continuation-in-part of prior application Ser. No. 276,010 filed on Nov. 25, 1988, now abandoned.

NATURE OF THE INVENTION

This invention relates to lubricant and hydrocarbon fuel compositions. More specifically it is concerned with the reaction products of long chain alkylene oxides and polyamines to form hydroxyalkylated polyamines useful as multifunctional detergents, dispersants, and antioxidants in lubricant and fuel compositions including liquid hydrocarbons and oxygenated fuels such as alcohols and ether compounds.

SUMMARY OF THE INVENTION

Briefly stated this invention comprises in one aspect a lubricant or liquid hydrocarbon fuel composition containing in addition to a major portion of a lubricant or liquid hydrocarbon fuel a minor portion of an additive composition which is the reaction product of a long chain alkylene oxide or mixture of alkylene oxides and a polyamine or mixture of polyamines.

DESCRIPTION OF THE INVENTION

As indicated above this invention comprises a lubricant or liquid hydrocarbon fuel composition containing the reaction product of a long chain alkylene oxide or mixture of long chain alkylene oxides reacted with a polyamine or mixture of polyamines. The alkylene oxides have the structural formula:

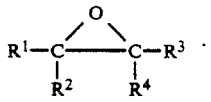

where $R^1$, $R^2$, $R^3$ and $R^4$ are hydrogen or hydrocarbyl radicals of 1 to 30 carbon atoms. Non-limiting examples of suitable alkylene oxides include ethylene oxide, propylene oxide, butylene oxide, pentylene oxide, decylene oxide, dodecylene oxide, hexadecylene oxide, octadecylene oxide, styrene oxide, stilbene oxide and cyclohexylene oxide as well as any of the isomers of the foregoing.

$$H_2N\text{-}(R^5\text{-}\underset{\underset{R^7}{|}}{N})_x R^6\text{-}NH_2$$

where $R^5$ is a hydrocarbyl radical having 1 to 4 carbon atoms, usually aliphatic, $R^6$ is a hydrocarbyl radical of 1 to 4 carbon atoms, usually aliphatic, and $R^7$ is hydrogen or has the structural formula:

$$R^8\text{-}NH_2$$

where $R^8$ is a hydrocarbyl radical having 1 to 4 carbon atoms, usually aliphatic, and x is a number ranging from 0 to 4. Examples of suitable polyamines include, but are not limited to, polyethyleneamines such as ethylene diamine, diethylene triamine, triethylene tetramine, tetraethylene pentamine, and pentaethylene hexamine, polypropyleneamines, and other amines which contain at least two nitrogens, at least one of which is a primary or secondary nitrogen, such as tris(2-aminoethyl)amine.

The alkylene oxide and polyamine are reacted in a mole ratio of between 1 and Y moles of alkylene oxide per mole of polyamine where Y equals the total number of hydrogens bound to the nitrogens of the polyamine, preferably at a temperature of 100° C. to 250° C. at ambient pressure. If desired, the reaction can be conducted in a carrier solvent such as xylenes or toluene. After reaction is complete the reaction mass is treated to remove any solvent or water of reaction. The resulting product is the desired additive product. Although we do not wish to be bound by it, it is thought that the reaction product of the alkylene oxide and the polyamine has the general formula:

$$H_dR_a{}^9N\text{-}R^5\text{-}NR_b{}^9H_e)_xR^6\text{-}NR_c{}^9H_f$$

where $R^9$ has the general formula:

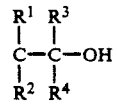

$R^5$ and $R^6$ are hydrocarbyl radicals, usually aliphatic, having 1 to 4 carbon atoms, x is a number ranging from 0 to 4, $R^1$,$R^2$,$R^3$ and $R^4$ are hydrogen or hydrocarbyl radicals of 1 to 30 carbon atoms, a, b, c, d, e, and f are each 0 to 2 providing their sum equals x+4, a+d and c+f each equal 2 and b+e equals 1.

If the additive composition is to be used in formulating a lubricant it is used in concentration of between 0.1% and 10% by weight of the total composition. If the additive is to be used in a fuel it is added in a concentration of between 25 and 500 pounds of additive per 1000 barrels of fuel.

An important feature of the invention is the ability of the additive to improve the antiwear and dispersant properties and the resistance to oxidation of a lubricating oil such as mineral oil, synthetic oils, mixtures of these, or a grease in which any of the aforementioned oils are employed as a vehicle. In general, the mineral oils, both paraffinic, naphthenic and mixtures thereof, employed as a lubricating oil or as the grease vehicle, can be of any suitable lubricating viscosity range, as for example, from about 45 SSU at 100° F. to about 6000 SSU at 100° F., and preferably from about 50 to about 250 SSU at 210° F. These oils may have viscosity indexes ranging to 100 or higher. Viscosity indexes from about 70 to about 95 are preferred. The average molecular weights of these oils can range from about 250 to about 800.

Where the lubricant is employed as a grease, the lubricating oil is generally used in an amount sufficient to balance the total grease composition, after accounting for the desired quantity of the thickening agent, and other additive components included in the grease formulation. A wide variety of materials can be employed as thickening or gelling agents. These can include any of the conventional metal salts or soaps, such as calcium, or lithium stearates or hydroxystearates, which are dispersed in the lubricating vehicle in grease-forming quantities in an amount to impart to the resulting grease composition the desired consistency. Other thickening agents that can be employed in the grease formulation comprise the non-soap thickeners, such as surface-modified clays and silicas, aryl ureas, calcium complexes and similar materials. In general, grease thickeners can be employed which do not melt and dissolve when used at the required temperature within a particular environment; however, in all other respects, any material which is normally employed for thickening or gelling hydrocarbon fluids for forming grease can be used in preparing the aforementioned improved grease in accordance with the present invention.

In instances where synthetic oils, or synthetic oils employed as the vehicle for the grease, are desired in preference to mineral oils, or in preference to mixtures of mineral and synthetic oils, various synthetic oils may be utilized successfully. Typical synthetic oil vehicles include polyisobutylenes, polybutenes, hydrogenated polydecenes, polypropylene glycol, polyethylene glycol, trimethylol propane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes) and alkyl-substituted diphenyl ethers typified by a butyl-substituted bis(p-phenoxy phenyl) ether, and phenoxy phenylethers.

It is to be understood that the compositions contemplated herein can also contain other materials. For example, corrosion inhibitors, extreme pressure agents, viscosity index improvers, coantioxidants, antiwear agents and the like can be used. These include, but are not limited to, phenates, sulfonates, succinimides, zinc dialkyl or diaryl dithiophosphates, and the like. These materials do not detract from the value of the compositions of this invention.

The products of this invention can also be employed in liquid hydrocarbon fuels, and in oxygenated fuels such as alcohol fuels, ether compounds or mixtures thereof, including mixtures of hydrocarbons, mixtures of alcohols and mixtures of hydrocarbon and alcohol fuels. Liquid hydrocarbon fuels include gasoline, fuel oils, diesel oils, and alcohol fuels include methyl and ethyl alcohols.

EXAMPLE 1

TEPA (tetraethylenepentamine) (56.7 grams, 0.3 mole) and 300 ml of xylenes were charged to a reactor equipped with a Dean-Stark trap for water collection and heated and refluxed for 2 hours under a continuous nitrogen atmosphere. Less than 0.5 ml water was collected. The reaction mixture was cooled to room temperature and 338.4 grams (1.2 mole) of 1,2-epoxyoctadecane were added. The mixture was heated to 175° C. and the xylenes distilled off. After a reaction period of 3.5 hours thin layer chromatography showed that all of the 1,2-epoxyoctadecane had reacted. The reaction mixture was then stripped under vacuum at 150° C. until no more xylenes distilled off. The resulting tan-colored liquid product solidified into a waxy solid upon cooling.

EXAMPLE 2

Tris(2-aminoethyl)amine (65.8 grams, 0.45 mole) and 300 ml of xylenes were charged to a reactor equipped with a Dean-Stark trap for water collection and heated and refluxed for 2 hours under a continuous nitrogen atmosphere. The amount of water collected was 0.2 ml. The reaction mixture was allowed to cool to room temperature and 380.7 grams (1.35 mole) of 1,2-epoxyoctadecane were added. The reaction mixture was heated to 175° C. and the xylenes distilled off. After a reaction period of 5 hours thin layer chromatography showed that all of the 1,2-epoxyoctadecane had reacted. The reaction mixture was stripped under vacuum at 150° C. until no more xylenes distilled off. The resulting product again was a tan liquid which solidified into a waxy solid upon cooling. The products from Examples 1 and 2 were tested for antioxidant properties at a 1% concentration in a neutral base stock oil. Results are shown in the following table.

| | Catalytic Oxidation Test 325° F., 40 hours | |
|---|---|---|
| Additive | Δ NN | % Δ KV |
| None | 8.5 | 104.4 |
| Example 1 | 6.6 | 26.1 |
| Example 2 | 6.4 | 37.8 |

We claim:

1. A lubricant composition consisting essentially of a major proportion of a lubricant and an antioxidant and dispersant amount of a reaction product obtained by reacting a linear, long chain octadecylene oxide with a polyamine which has the structural formula:

$$H_2N\left(R^5-\underset{\substack{|\\R^7}}{N}\right)_x R^6-NH_2$$

where $R^5$ is a hydrocarbyl radical having 1 to 4 carbon atoms, $R^6$ is a hydrocarbyl radical of 1 to 4 carbon atoms, and $R^7$ is a hydrogen or has the structural formula:

$$R^8-NH_2$$

where $R^8$ is a hydrocarbyl radical having 1 to 4 carbon atoms and x is a number ranging from 0 to 4, the oxide and the polyamine are reacted in a mole ratio of between at least 3 and Y moles of oxide per mole of polyamine where Y equals the total number of hydrogen atoms bound to the nitrogen atoms of the polyamine.

2. The composition of claim 1 wherein the polyamine is a polyethyleneamine selected from the group consisting of ethylene diamine, diethylene triamine, triethylene tetramine, tetraethylene pentamine, pentaethylene hexamine, and tris(2-aminoethyl)amine.

3. The composition of claim 1 wherein the polyamine is a polypropyleneamine.

4. The composition of claim 1 wherein the reaction is conducted at a temperature of about 100° C. to about 250° C. at ambient pressure.

5. The composition of claim 1 wherein the reaction is conducted in a carrier solvent selected from the group consisting of xylene and toluene.

6. The composition of claim 1 wherein the concentration of said reaction product in said lubricant is between about 0.1% and about 10% by weight of the total composition.

7. The composition of claim 1 wherein the oxide is 1,2-epoxyoctadecane and the polyamine is tetraethylenepentamine.

8. The composition of claim 1 wherein the oxide is 1,2-epoxyoctadecane and the polyamine is tris(2-aminoethyl) amine.

9. A method for making a lubricant composition comprising adding to a lubricant an antioxidant and dispersant amount of a reaction product consisting essentially of that obtained by reacting a linear, long chain octadecylene oxide with a polyamine which has the structural formula:

$$H_2N\left(R^5-\underset{\underset{R^7}{|}}{N}\right)_x R^6-NH_2$$

where $R^5$ is a hydrocarbyl radical having 1 to 4 carbon atoms, $R^6$ is a hydrocarbyl radical of 1 to 4 carbon atoms and $R^7$ is hydrogen or has the structural formula:

$$R^8-NH_2$$

where $R^8$ is a hydrocarbyl radical having 1 to 4 carbon atoms and x is a number ranging from 0 to 4, the oxide and the polyamine are reacted in a mole ratio of between at least 3 and Y moles of alkylene oxide per mole of polyamine where Y equals the total number of hydrogen atoms bound to the nitrogen atoms of the polyamine.

10. The method of claim 9 wherein the polyamine is a polyethyleneamine selected from the group consisting of ethylene diamine, diethylene triamine, triethylene tetramine, tetraethylene pentamine, pentaethylene hexamine, and tris(2-aminoethyl) amine.

11. The method of claim 9 wherein the polyamine is a polypropyleneamine.

12. The method of claim 9 wherein the reaction is conducted at a temperature of about 100° C. to about 250° C. at ambient pressure.

13. The method of claim 9 wherein the reaction is conducted in a carrier solvent selected from the group consisting of xylene and toluene.

14. The method of claim 9 wherein the concentration of said reaction product in said lubricant is between about 0.1% and about 10% by weight of the total composition.

15. The method of claim 9 wherein the oxide is 1,2-epoxyoctadecane and the polyamine is tetraethylenepentamine.

16. The method of claim 9 wherein the oxide is 1,2-epoxyoctadecane and the polyamine is tris(2-aminoethyl) amine.

* * * * *